US005533307A

United States Patent [19]

Tsai et al.

[11] Patent Number: 5,533,307

[45] Date of Patent: Jul. 9, 1996

[54] SEISMIC ENERGY DISSIPATION DEVICE

[75] Inventors: Keh-Chyuan Tsai; Jeng-Wei Li, both of Taipei, Taiwan

[73] Assignee: National Science Council, Taipei, Taiwan

[21] Appl. No.: 350,043

[22] Filed: Nov. 29, 1994

[51] Int. Cl.[6] ..... E04H 9/02

[52] U.S. Cl. ..... 52/167.3; 52/167.1

[58] Field of Search ..... 52/167.1, 167.2, 52/167.3, 167.4, 167.5, 167.6

[56] References Cited

U.S. PATENT DOCUMENTS

| | | | |
|---|---|---|---|
| 4,094,111 | 6/1978 | Creegan | 52/167.4 |
| 4,823,522 | 4/1989 | White | 52/167.4 X |

FOREIGN PATENT DOCUMENTS

| | | | |
|---|---|---|---|
| 2-144435 | 6/1990 | Japan | 52/167.3 |
| WO91/08363 | 6/1991 | WIPO | 52/167.4 |

OTHER PUBLICATIONS

"Taming Structural Vibrations", *Civil Engineering Magazine*, Nov. 1990, pp. 57–59, Charles H. Thornton et al.

Article entitled "Seismic Testing of Steel Plate Energy Dissipation Devices" by Whittaker et al., Earthquake Spectra, vol. 7, No. 4, 1991.

*Primary Examiner*—Carl D. Freidman
*Assistant Examiner*—Kevin D. Wilkens
*Attorney, Agent, or Firm*—Michael D. Bednarek; Marks & Murase

[57] ABSTRACT

Two energy dissipation devices, each comprising a first plate, a plurality of spaced tapered plates, a plurality of cylinders, a plurality of washers, and a base frame. The devices can absorb seismic energy through the yielding of the tapered plates and effectively reduce a building vibration response during an earthquake. The devices are particularly suitable for use in building structures that must be designed to dissipate a large amount of seismic energy to achieve economical earthquake-resistant construction.

16 Claims, 11 Drawing Sheets

SEISMIC ENERGY DISSIPATION DEVICE

BACKGROUND OF THE INVENTION

1. Field of the Invention

The present invention relates to a seismic energy dissipation device, and in particular to a seismic energy dissipation device having excellent energy dissipation capacity.

2. Description of Prior Art

During the past few years, it has been realized that earthquake-induced energy in building structures can be effectively dissipated by the use of certain structural devices. For example, one such device, known as bolted X-shaped steel plate added damping and stiffness (ADAS) devices, was disclosed by Whittaker et al. in "*Seismic Testing of Steel Plate Energy Dissipation Devices*", Earthquake Spectral 7(4): at 563–604, EERI (Nov. 1991). Recent experimental results obtained by the National Taiwan University also indicate that properly welded steel triangular-plate added damping and stiffness (TADAS) devices can sustain a very large number of yielding reversals without any sign of stiffness or strength degradation.

FIG. 1 is a perspective exploded diagram of a typical welded TADAS device. The TADAS device comprises a plate 10, a plurality of triangular plates 20, a plurality of blocks 30, a base 40, and a plurality of pins 41. The narrower ends of the triangular plates 20 are respectively connected to the blocks 30, while the wider ends are connected to the plate 10. The blocks 30 are pivoted to the base 40 through the pins 41. FIG. 2 shows the assembly of the typical welded TADAS device.

The typical welded TADAS device has significant drawbacks. It has rigidly precise requirements for the distance between the blocks 30 to allow the pins 41 to be put into the holes 31, 42. However, such strict precision is difficult to attain because the plate 10, the triangular plates 20, and the blocks 30 are welded together (it is noted that casting them as a single piece can be done with greater precision but results in less ductility, an undesirable characteristic for an earthquake-resistance device). Therefore, assembling the welded TADAS is troublesome.

When a transverse force is applied, the triangular plates 20 can deform well into the inelastic range since the curvature distribution is uniform over the triangular plate height. However, the spacing between the triangular plates decreases as the device deformation increases. Thus, eventual collisions between the blocks may occur as shown in FIG. 3. This changes each end of the triangular plates from a roller to a more-fixed boundary condition, and results in sudden increases of the force response of the device after the collisions of the blocks. In other words, when the blocks 30 collide with each other the original design of the triangular-plate device fails to work creating a dangerous condition in the building structure.

SUMMARY OF THE INVENTION

A primary object of the present invention is to provide a seismic energy dissipation device that has excellent energy dissipation capacity.

A secondary object of the present invention is to provide a seismic energy dissipation device that is easily assembled.

Additional objects, advantages, and novel features of the invention will be set forth in the description that follows, and will become apparent to those skilled in the art upon reading this description or practicing the invention.

In accordance with the objects of the present invention, there is provided a seismic energy dissipation device. The seismic energy dissipation device comprises a first plate member; a plurality of cylinder members; a plurality of spaced tapered plate members, each tapered plate member having a first end connected to the first plate member and a second end connected to a respective one of the cylinder members, the second end being narrower than the first end; and a base frame member comprising a base plate and a pair of parallel wall members, each of the parallel wall members being secured to the base plate and provided with a plurality of notches for receiving the plurality of cylinder members, respectively.

Alternatively, the seismic energy dissipation device comprises a first plate member; a plurality of cylinder members; a plurality of spaced tapered plate members, each tapered plate member having a first end connected to the first plate member, and a second end connected to a respective one of the cylinder members, the second end being narrower than the first end; and a base frame member comprising a base plate, a pair of parallel wall members secured to the base plate, and a plurality of parallel partitions secured to the base plate between the parallel wall members to form a plurality of grooves for receiving the plurality of cylinder members, respectively.

According to another aspect of the present invention, a device for dissipating seismic energy is provided, comprising a first member; a plurality of spaced tapered plate members each having a first end fixed to the first member and a second end, the second end being narrower than the first end; a plurality of cylindrical members each connected to a respective one of the second ends of the tapered plate members; and a base assembly having a plurality of spaced receiving means for receiving the cylindrical members, the receiving means being open on a side facing the first member to receive the cylindrical members.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE PREFERRED EMBODIMENT

Figure 1:
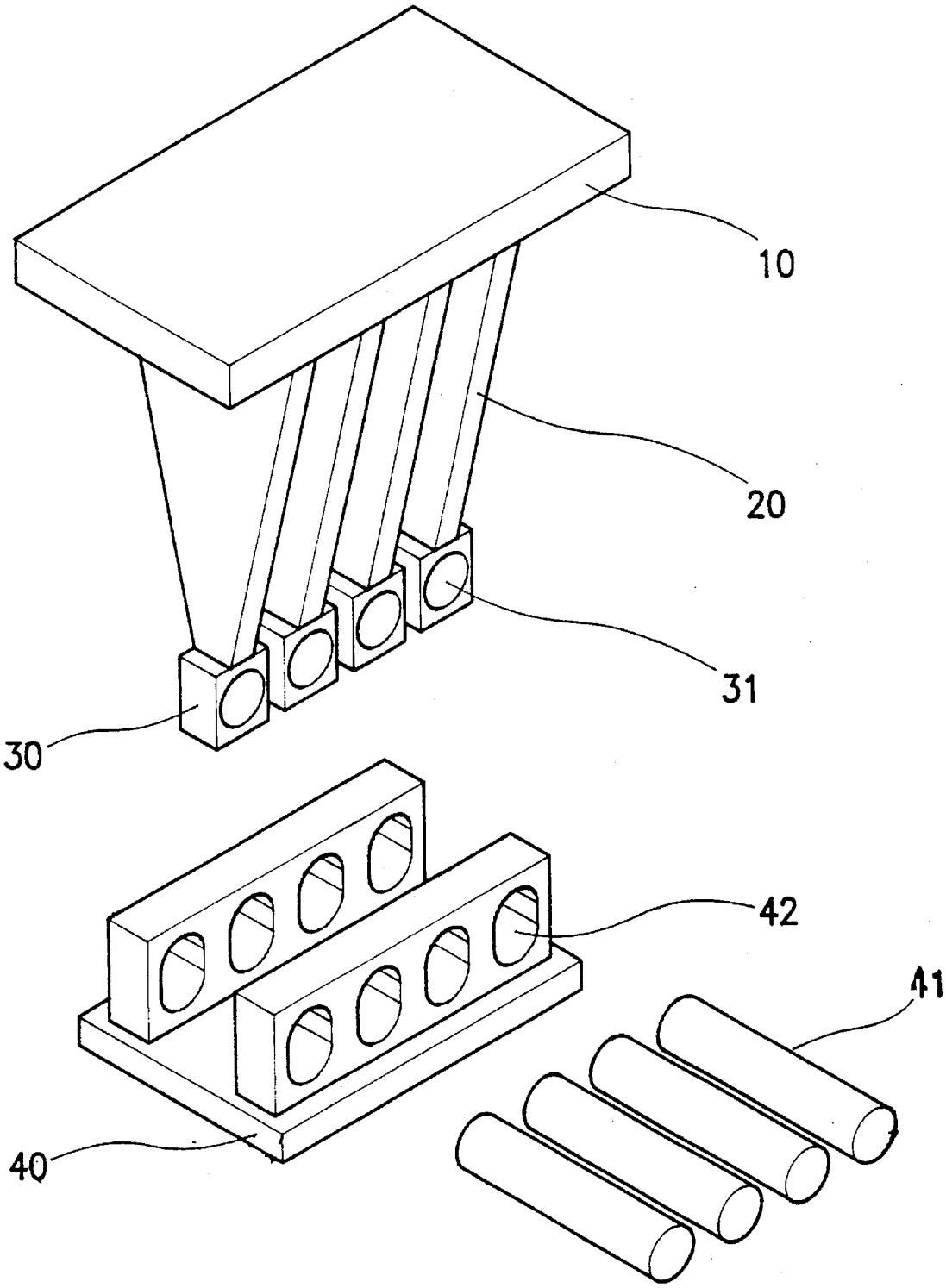
FIG. 1 (PRIOR ART)
FIG. 1 is a perspective exploded diagram of a typical welded TADAS device.
Figure 2:
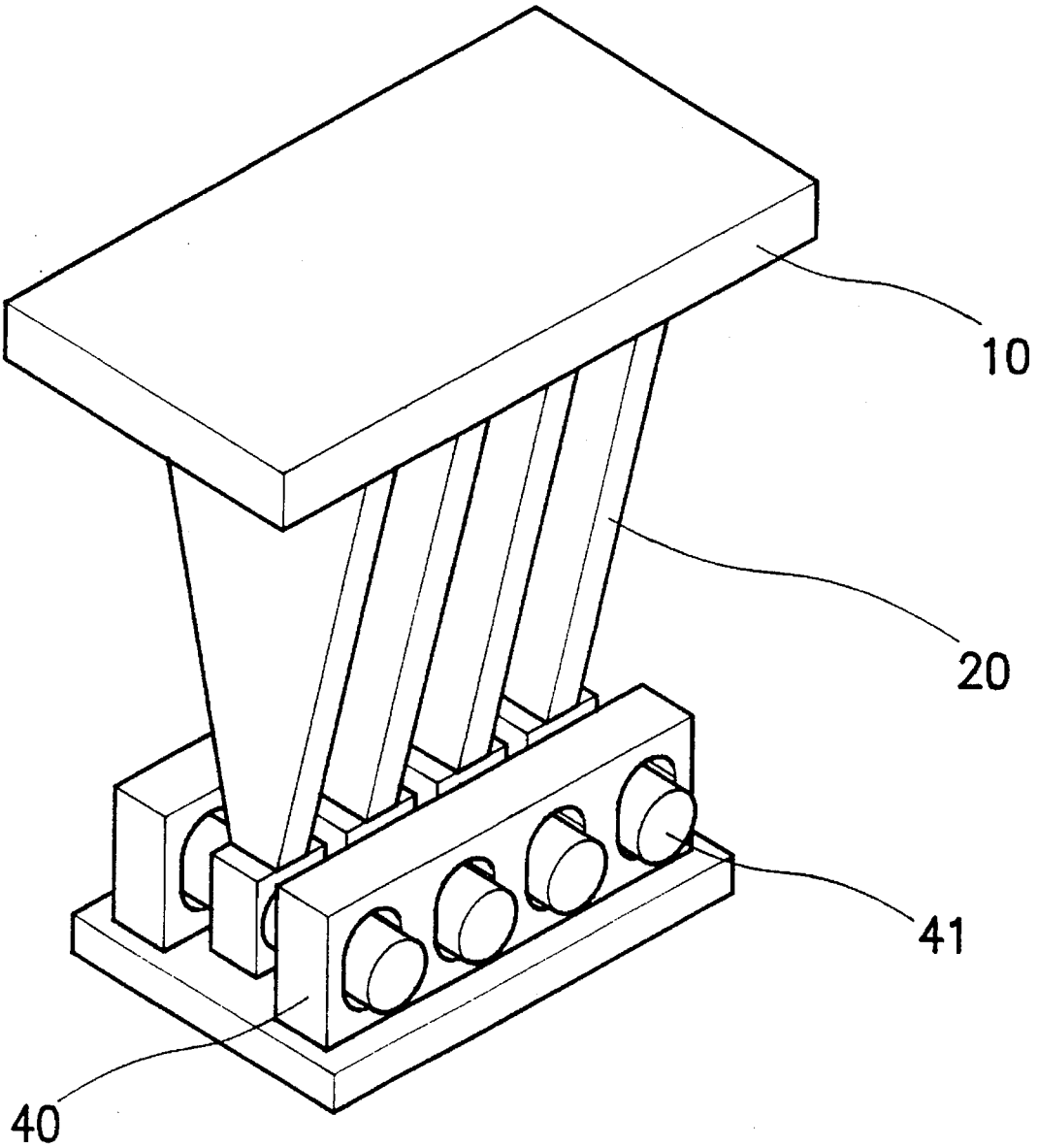
FIG. 2 (PRIOR ART)
FIG. 2 shows the assembly of the typical welded TADAS device.
Figure 3:
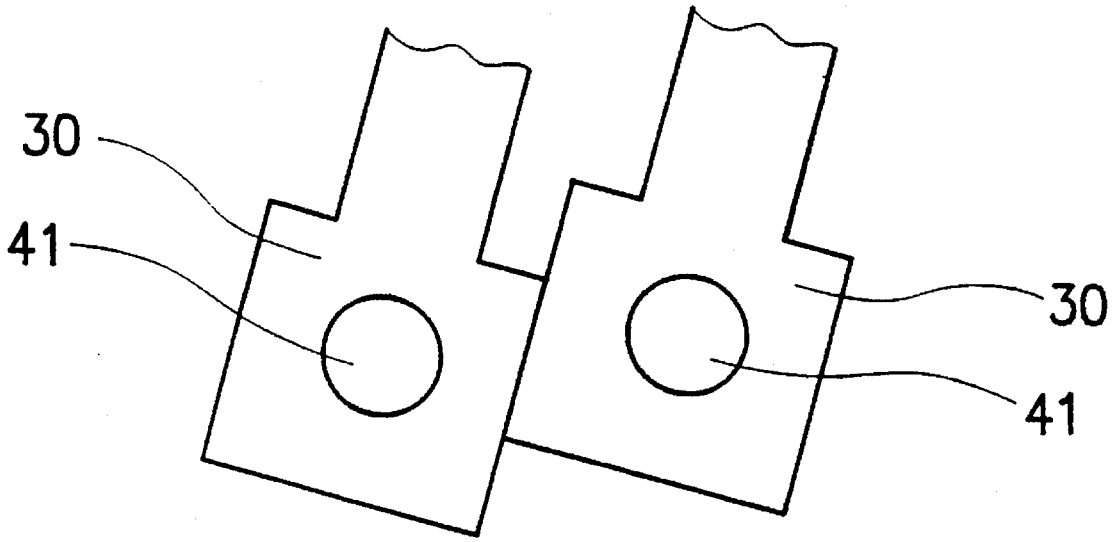
FIG. 3(PRIOR ART)
FIG. 3 shows the collision of the blocks of the typical welded TADAS device.
Figure 4:
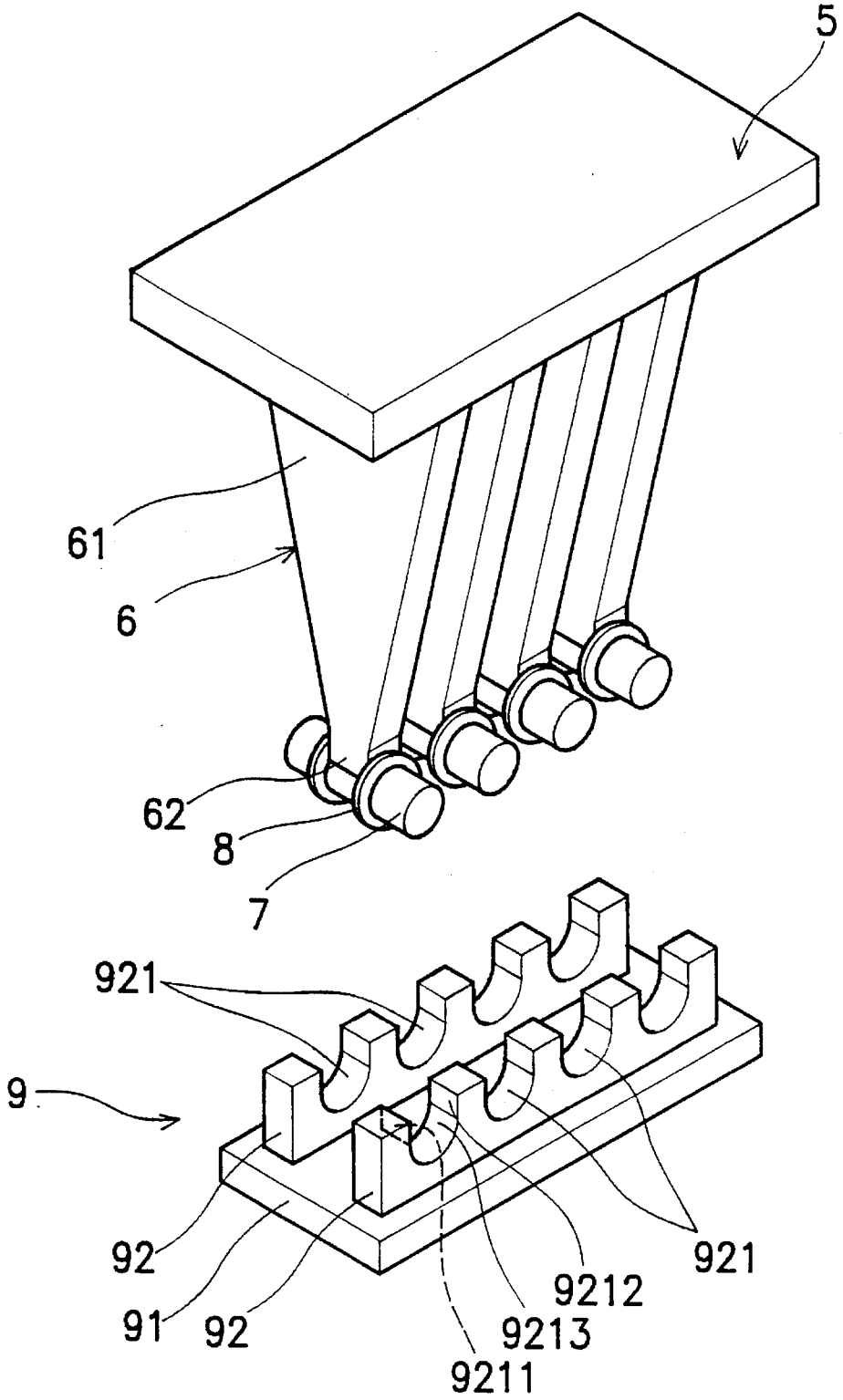
FIG. 4 is a perspective exploded diagram of a seismic energy dissipation device according to a first embodiment of the invention.

FIG. 4 is a perspective exploded diagram of a seismic energy dissipation device according to the first embodiment of the invention. The seismic energy dissipation device comprises a first plate 5, a plurality of spaced tapered plates 6, a plurality of cylinders 7, a plurality of circular washers 8 (i.e.,spacers), and a base frame 9. The wider ends 61 of the tapered plates 6 are connected to the first plate 5, while the narrower ends 62 of the tapered plates 6 are connected to the cylinders 7 (e.g., by welding). The circular washers 8 are disposed on both sides of the tapered plates 6 on each one of the cylinders 7. The base frame 9 comprises a base plate 91 and a pair of parallel walls 92. The walls 92 are secured to the base plate 91 and are provided with a plurality of notches 921 (i.e., open grooves). Each of the notches 921 have an inner surface comprising a first surface 9211, a second surface 9212, and a third surface 9213. The third surface 9213 is arcuate and is formed between the first surface 9211 and the second surface 9212 so that the first surface 9211 is opposite to the second surface 9212.

Figure 5:
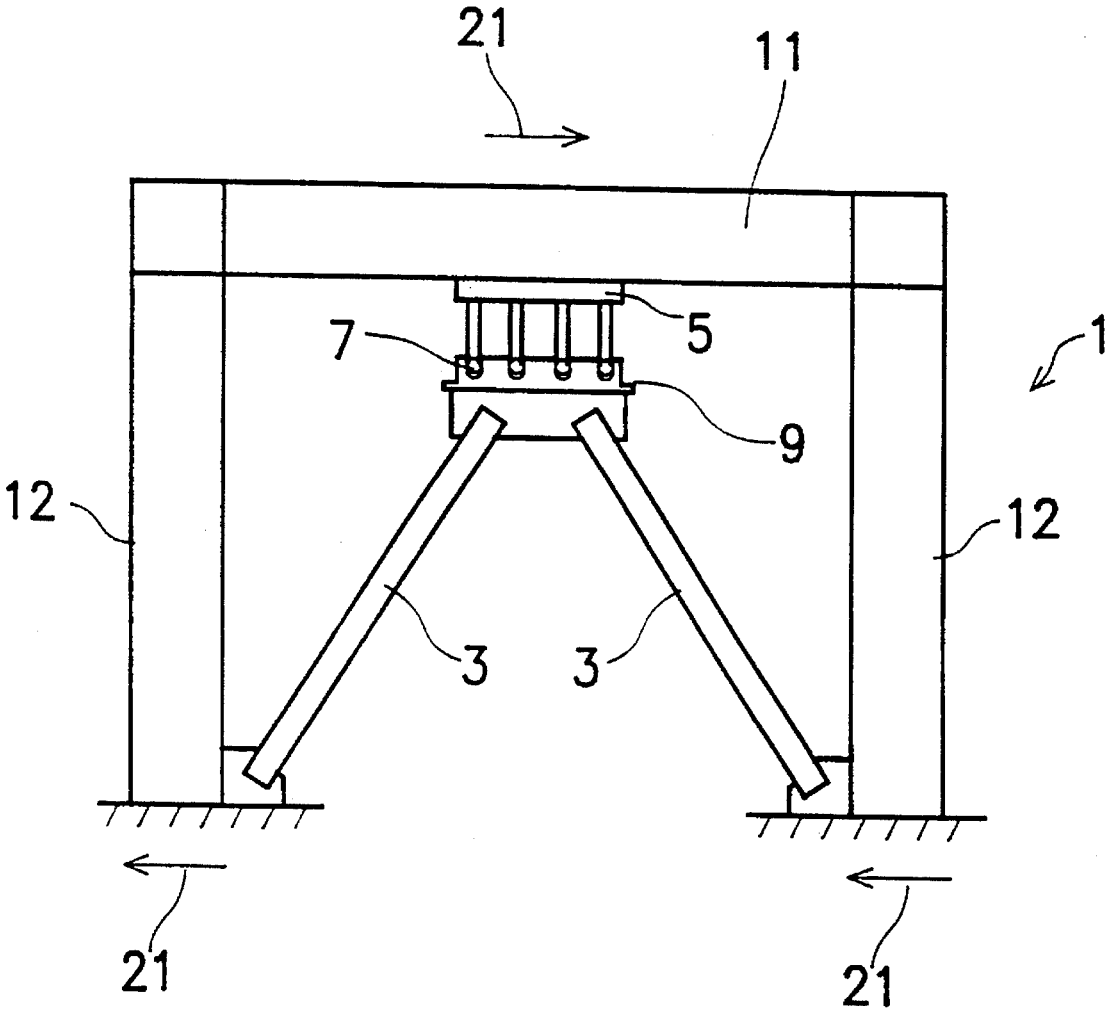
FIG. 5 shows an example of mounting the seismic energy dissipation device according to the first embodiment to a steel frame.

An example of mounting the seismic energy dissipation device to a steel frame 1 is shown in FIG. 5. The steel frame 1 comprises a beam 11 and two columns 12. The first plate 5 is connected to the beam 11, and the base frame 9 is connected to the columns 12 through two inclined struts 3.

Figure 6:
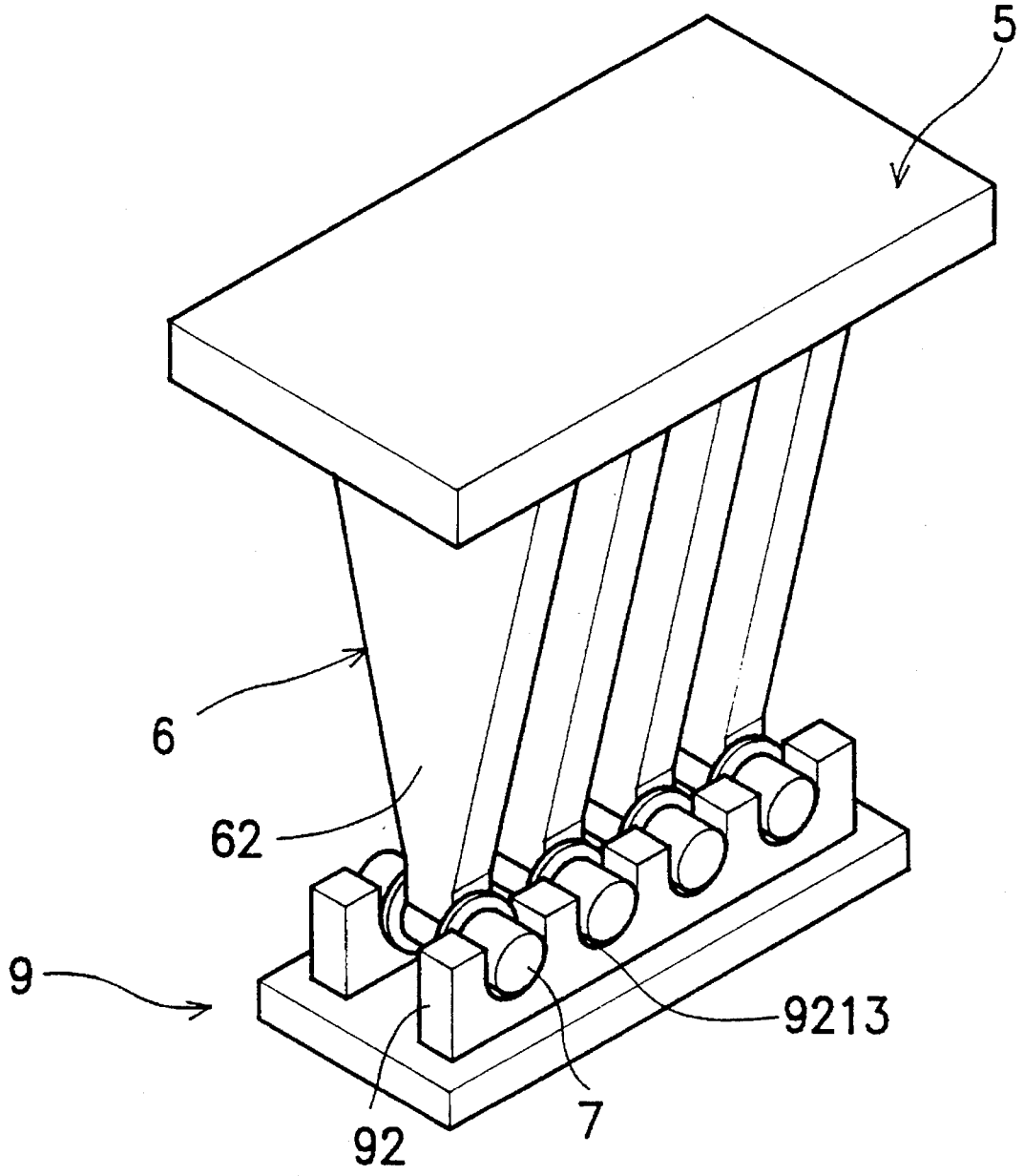
FIG. 6 shows the assembly of the seismic energy dissipation device according to the first embodiment.

FIG. 6 shows the assembly of the seismic energy dissipation device according to FIG. 5. The cylinders 7 can be put directly into the notches 921 without touching the third surfaces 9213 thereof (i.e., there is a space between the third surface 9213 and the cylinder 7). In this manner, the assembly method of the present invention is easier than the assembly of the prior art TADAS device because it does not require such rigid precision in distances between the cylinders 7. The circular washers 8 fill the space between the walls 92 and the narrower ends 62 of the tapered plates 6 to prevent undesirable free play after assembly.

Figure 7:
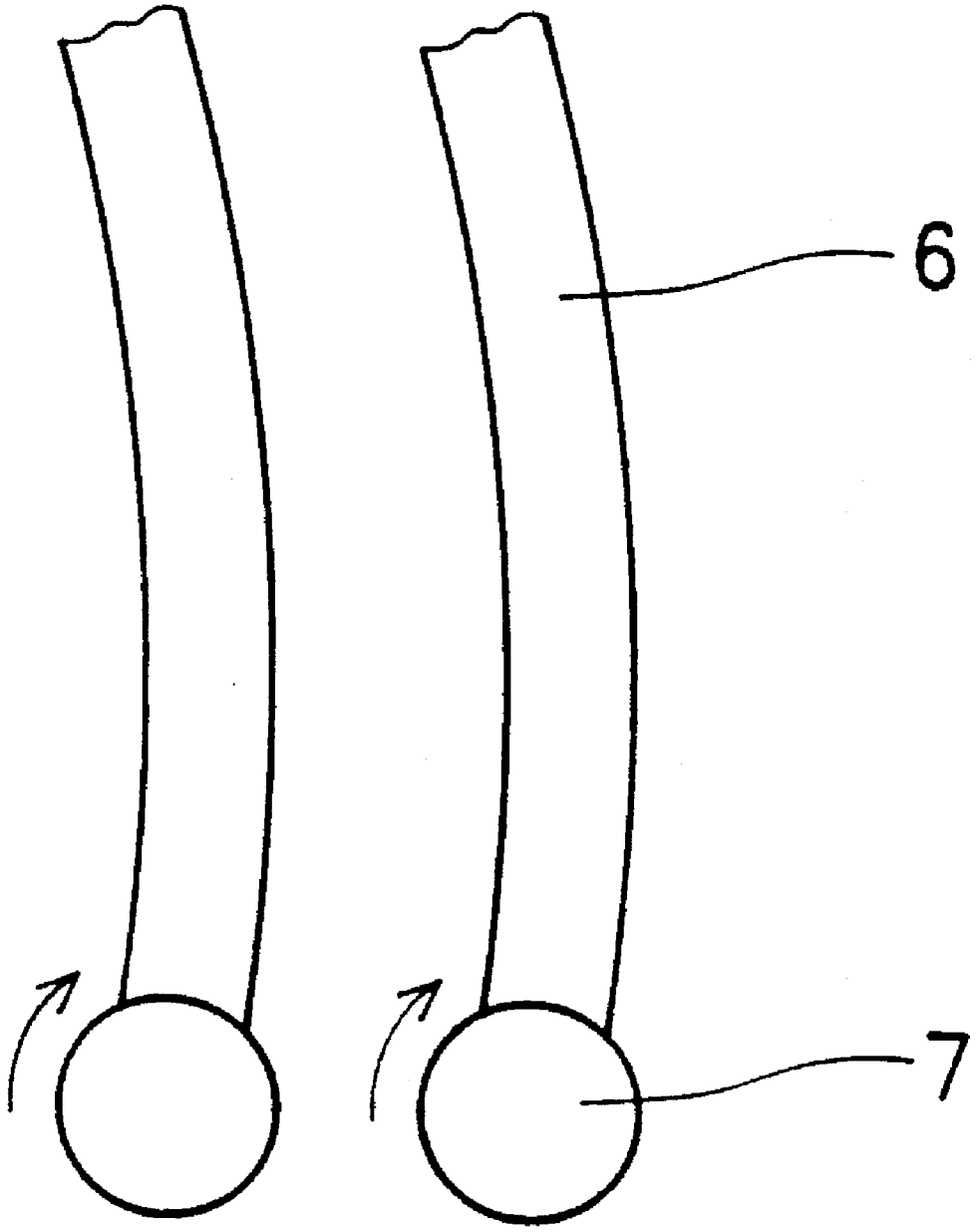
FIG. 7 shows the rotating situation of the cylinders of the seismic energy dissipation device according to the present invention upon a transverse force being applied thereto.

As shown in FIGS. 5 and 7, when lateral forces 21 are applied to the steel frame 1, the tapered plates 6 deform and no eventual collisions between the cylinders 7 occur. Each end of the tapered plates always remains a roller, thereby eliminating any unexpected destruction of the seismic energy dissipation device resulting from sudden increases of stiffness. In other words, the seismic energy dissipation device has improved energy dissipation capacity.

As described above, the cylinders 7 do not touch the third surfaces 9213 of the notches 921. Such as arrangement allows the cylinders 7 to move with respect to the base frame 9 in the vertical direction. Therefore the effects of gravity load in the steel frame 1 can be separated from the seismic energy dissipation device(i.e., no vertical forces resulting from gravity, such as the weight of the beam 11, are exerted on the tapered plates 6). This makes inelastic responses of the seismic energy dissipation device highly predictable.

Figure 8:
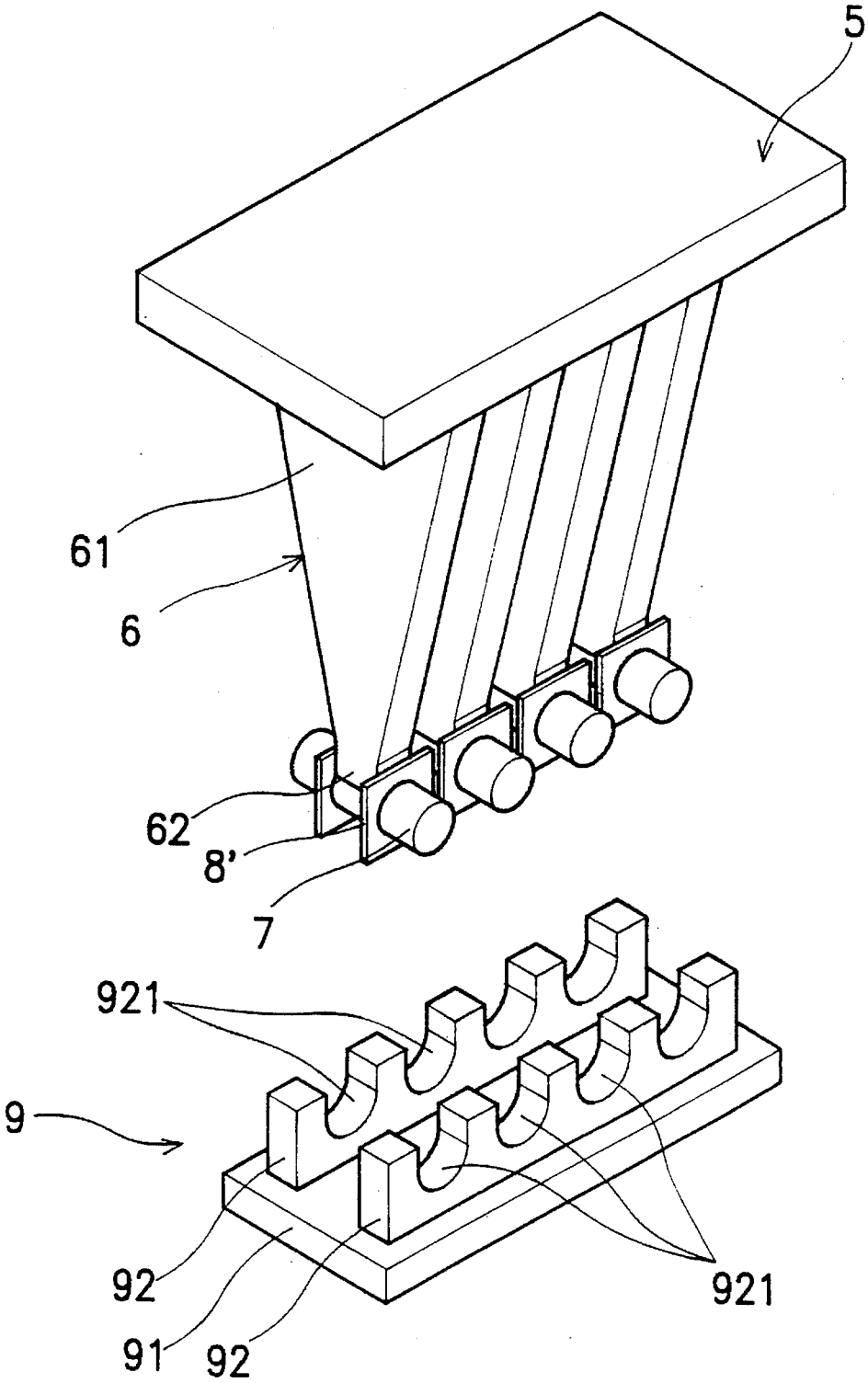
FIG. 8 is a perspective exploded diagram of a seismic energy dissipation device according to the first embodiment having a plurality of rectangular washers.
Figure 9:
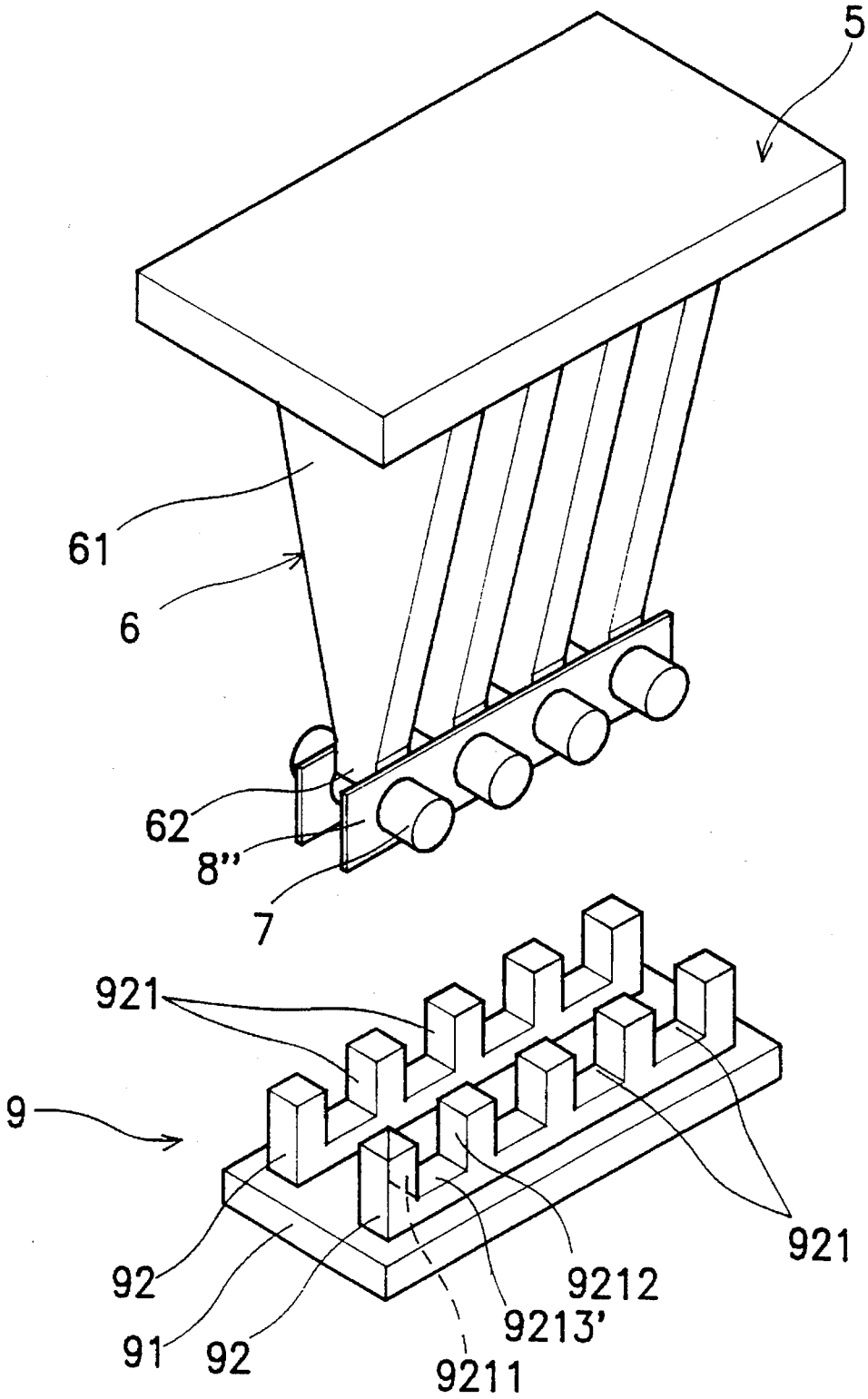
FIG. 9 is a perspective exploded diagrams of a seismic energy dissipation device according to the first embodiment having two plate washers.

It is not necessary for the washers 8 to be circular. A plurality of rectangular washers 8' can be used instead, as shown in FIG. 8. Alternatively, two plate washers 8", as shown in FIG. 9, can be placed around the cylinders 7 on both sides of the tapered plates 6 to fill the space between the walls 92 and the plurality of tapered plates 6. Another example of the base frame 9 is shown in FIG. 9. It is noted that each third surface 9213' formed between the first surface 9211 and the second surface 9212 is flat.

Figure 10:
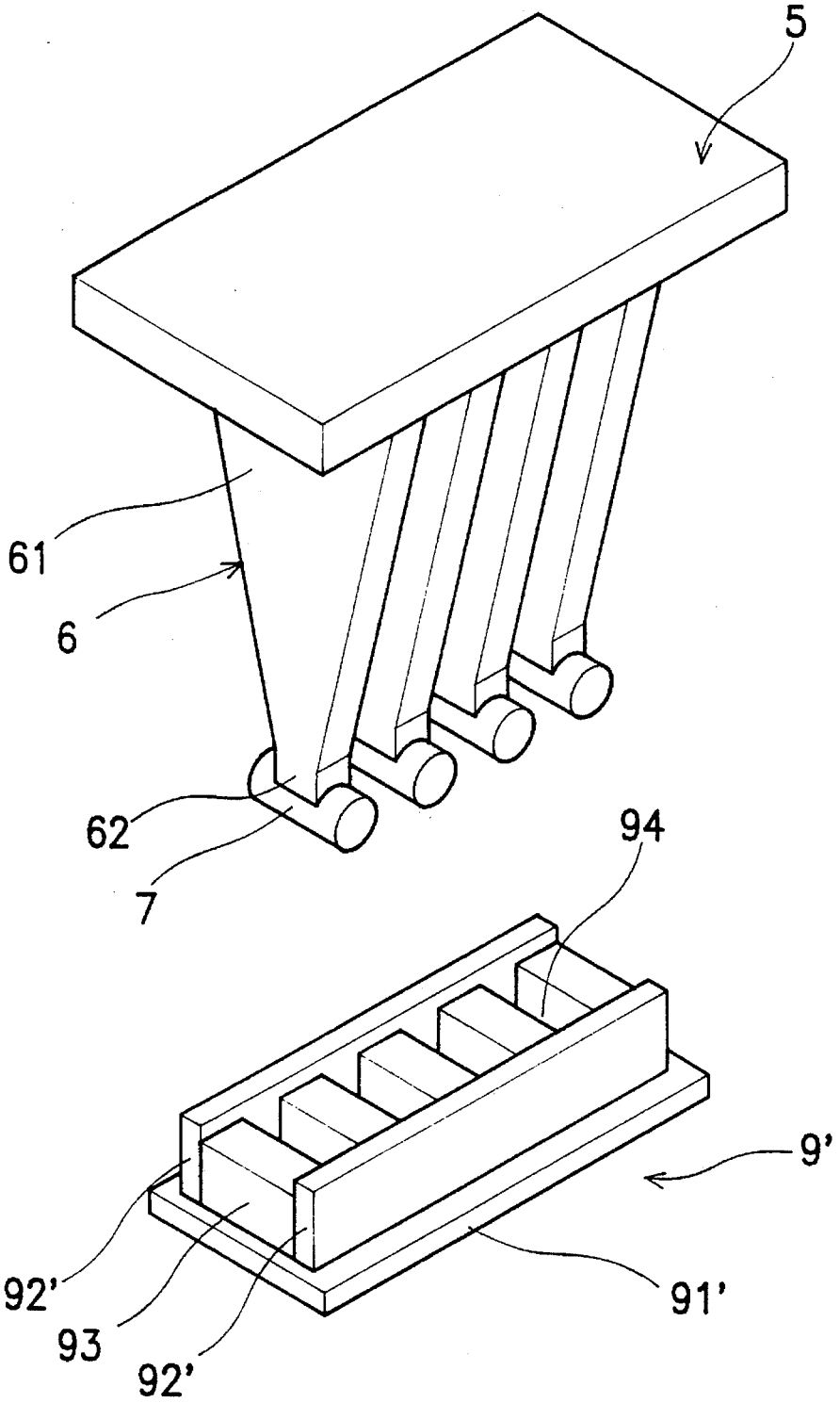
FIG. 10 is a perspective exploded diagram of a seismic energy dissipation device according to a second embodiment of the invention.

FIG. 10 is a perspective exploded diagram of a seismic energy dissipation device according to a second embodiment of this invention. The seismic energy dissipation device according to the second embodiment comprises a plate 5, a plurality of spaced tapered plates 6, a plurality of cylinders 7, and a base frame 9'. Only the base frame 9' is described here because the other elements are the same as those of the first embodiment.

Figure 11:
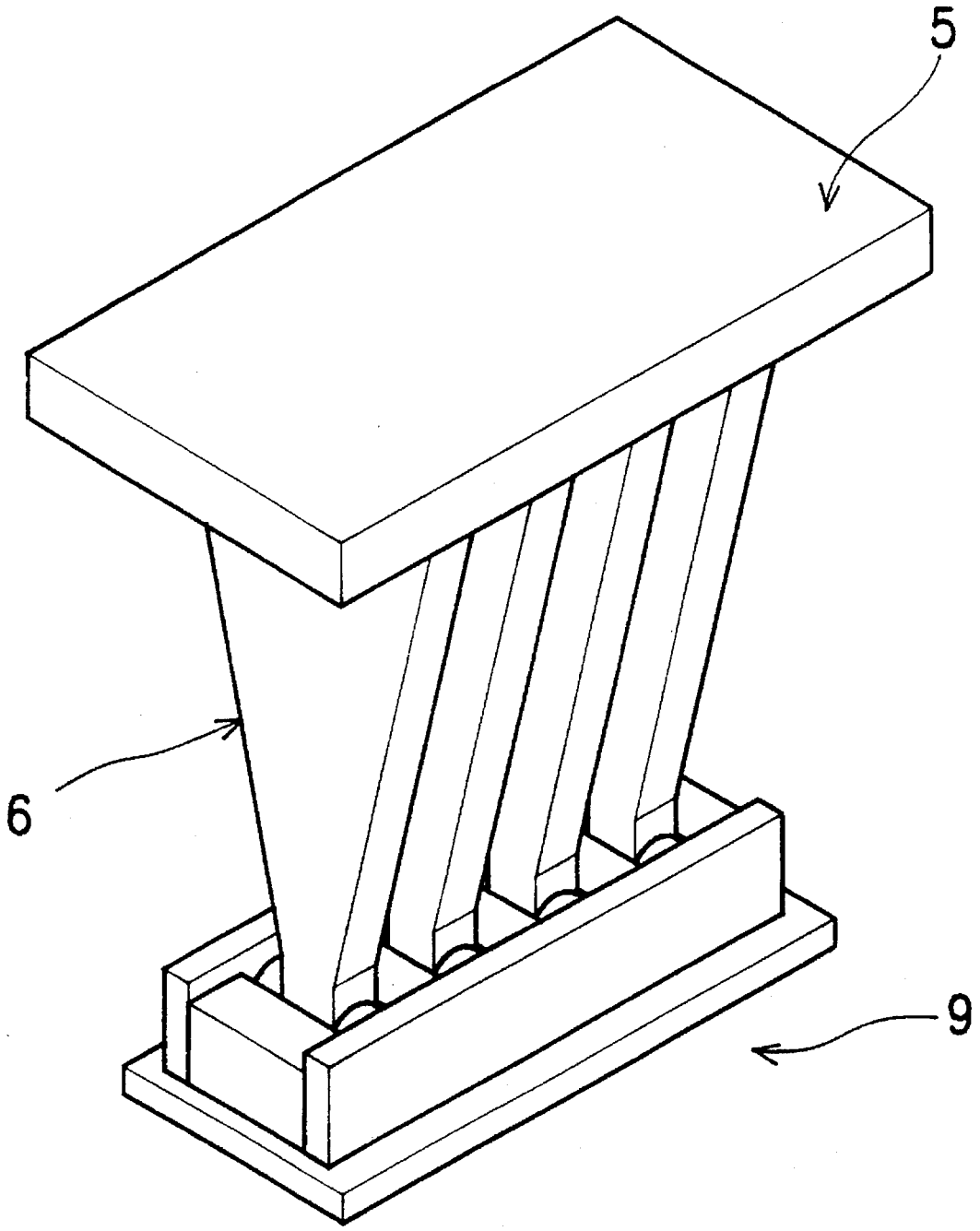
FIG. 11 shows the assembly of the seismic energy dissipation device according to the second embodiment.

The base frame 9' comprises a base plate 91', a pair of parallel walls 92', and a plurality of parallel partitions 93. The walls 92' and the partitions 93 are secured to the base plate 91'. The partitions 93 are positioned between the two walls 92' to form a plurality of grooves 94 for correspondingly receiving the cylinders 7. FIG. 11 shows the assembly of the seismic energy dissipation device according to the second embodiment. It should be noted that the cylinders 7 do not touch the base plate 91' of the base frame 9'.

FIG. 7 also shows the rotating situation for the cylinders of the seismic energy dissipation device according to the second embodiment, under a transverse force applied thereto. It is obvious that no eventual collisions between the cylinders occur.

Although this invention has been described in its preferred forms using various examples with a certain degree of particularity, it is understood that the present invention can vary in the details of construction according to the particular use contemplated. The scope of the invention should only be limited by the appended claims and not by the specific examples given.

What is claimed is:

1. A seismic energy dissipation device, comprising:

a first plate member;

a plurality of cylinder members;

a plurality of spaced tapered plate members, each tapered plate member having a first end connected to the first plate member and a second end connected to a respective one of the cylinder members, said second end being narrower than said first end; and a base frame member comprising a base plate and a pair of parallel wall members, each of said parallel wall members being secured to the base plate and provided with a plurality of open grooves for receiving the plurality of cylinder members, respectively.

2. The seismic energy dissipation device as claimed in claim 1, wherein each of the notches further has an inner surface comprising a first surface, a second surface opposite the first surface, and a third surface formed between the first surface and the second surface.

3. The seismic energy dissipation as claimed in claim 2, further comprising two plate washer members, each washer member being disposed around a respective end of the cylinder members on a respective side of the tapered plate members to fill a space between the parallel wall members and the tapered plate members.

4. The seismic energy dissipation device as claimed in claim 2, wherein said cylinder members are received in said notches, and a space is provided between the third surfaces and the cylinder members.

5. The seismic energy dissipation device as claimed in claim 4, wherein said first and second surfaces are generally parallel to each other, and said third surface is arcuate or flat.

6. The seismic energy dissipation device as claimed in claim 2, further comprising a plurality of washer members, a pair of said washer members being disposed on each one of the cylinder members on both sides of a respective one of the tapered plate members to fill a space between the parallel wall members and the plurality of tapered plate members.

7. The seismic energy dissipation device as claimed in claim 6, wherein the washer members are circular washer members.

8. The seismic energy dissipation device as claimed in claim 6, wherein the washer members are rectangular washer members.

9. A seismic energy dissipation device, comprising:

a first plate member;

a plurality of cylinder members;

a plurality of spaced tapered plate members, each tapered plate member having a first end connected to the first plate member, and a second end connected to a respective one of the cylinder members, said second end being narrower than said first end; and a base frame member comprising a base plate, a pair of parallel wall members secured to the base plate, and a plurality of parallel partitions secured to the base plate between the parallel wall members to form a plurality of grooves for receiving the plurality of cylinder members, respectively.

10. The seismic energy dissipation device as claimed in claim 9, wherein said cylinder members are received in said grooves, and a space is provided between the cylinder members and the base plate.

11. A device for dissipating seismic energy, comprising:

a first member;

a plurality of spaced tapered plate members each having a first end fixed to said first member and a second end, said second end being narrower than said first end;

a plurality of cylindrical members each connected to a respective one of said second ends of said tapered plate members; and a base assembly having a plurality of spaced receiving means for receiving said cylindrical members, said receiving means being open on a side facing said first member to receive said cylindrical members.

12. The device as claimed in claim 11, wherein each receiving means comprises a notch with an inner surface comprising a first surface, a second surface opposite the first surface, and a third surface formed between the first surface and the second surface.

13. The device as claimed in claim 12, wherein said first and second surfaces are generally parallel to each other, and said third surface is an arcuate or flat surface.

14. The device as claimed in claim 13, wherein said cylindrical members are fixed to said second ends of said tapered plate members.

15. The device as claimed in claim 14, wherein said base assembly comprises a base plate and first and second parallel wall members connected to said base plate, said first and second wall members each having a plurality of said notches formed therein.

16. The device as claimed in claim 11, wherein said base assembly comprises a base plate, first and second parallel wall members connected to said base plate, and a plurality of partitions positioned between the first and second wall members, said receiving means being defined by said partitions and said wall members.

* * * * *